US007743930B2

(12) United States Patent
Krohn

(10) Patent No.: US 7,743,930 B2
(45) Date of Patent: Jun. 29, 2010

(54) MOTOR DRIVEN STORAGE SYSTEM

(76) Inventor: Kurtis R Krohn, 164 Ringneck Trail, Mooresville, NC (US) 28117

( * ) Notice: Subject to any disclaimer, the term of this patent is extended or adjusted under 35 U.S.C. 154(b) by 367 days.

(21) Appl. No.: 11/400,503

(22) Filed: Apr. 7, 2006

(65) Prior Publication Data

US 2006/0226092 A1 Oct. 12, 2006

Related U.S. Application Data

(60) Provisional application No. 60/670,039, filed on Apr. 11, 2005.

(51) Int. Cl.
*A47F 3/08* (2006.01)

(52) U.S. Cl. ..... 211/1.51

(58) Field of Classification Search ..... 211/1.51–1.53, 211/1.55–1.57, 121–122; 312/134, 97, 266–268, 312/91; 198/802, 703, 710, 706, 798, 800, 198/801

See application file for complete search history.

(56) References Cited

U.S. PATENT DOCUMENTS

| | | | | | |
|---|---|---|---|---|---|
| 851,021 | A | * | 4/1907 | Murray | 198/797 |
| 988,262 | A | * | 3/1911 | Gulack | 211/121 |
| 1,270,001 | A | * | 6/1918 | Boos et al. | 198/800 |
| 1,426,379 | A | * | 8/1922 | Hadaway | 198/794 |
| 1,787,898 | A | * | 1/1931 | Fuller | 211/121 |
| 2,603,547 | A | * | 7/1952 | Zook | 312/268 |
| 2,609,112 | A | * | 9/1952 | McKenzie | 414/251 |
| 2,703,643 | A | * | 3/1955 | Parsons | 198/798 |
| 2,829,780 | A | * | 4/1958 | Boor | 211/121 |
| 2,912,118 | A | | 11/1959 | Behrens et al. | |
| 3,147,849 | A | * | 9/1964 | Scholfield et al. | 211/1.56 |
| 3,187,880 | A | * | 6/1965 | Frater et al. | 198/798 |
| 3,610,614 | A | * | 10/1971 | Nishizawa | 472/35 |
| 4,171,042 | A | * | 10/1979 | Meissner | 198/386 |
| 4,314,647 | A | | 2/1982 | Harris | |
| 5,040,689 | A | * | 8/1991 | Hull et al. | 211/121 |
| 5,339,968 | A | | 8/1994 | Voelz | |
| 5,513,501 | A | * | 5/1996 | Reed | 62/381 |
| 5,593,269 | A | * | 1/1997 | Bernard, II | 414/331.04 |
| 5,634,760 | A | | 6/1997 | Anderson et al. | |
| 5,738,225 | A | | 4/1998 | Kim | |
| 5,836,662 | A | | 11/1998 | Robey | |
| 5,863,172 | A | | 1/1999 | Pearson | |
| 6,119,880 | A | | 9/2000 | Dueck | |
| 6,502,707 | B1 | | 1/2003 | Sullivan | |
| 6,854,815 | B1 | | 2/2005 | Smith | |
| 2003/0226814 | A1 | * | 12/2003 | Taylor et al. | 211/40 |

FOREIGN PATENT DOCUMENTS

| | | |
|---|---|---|
| DE | 3825401 A1 | 1/1990 |
| EP | 0022441 A1 | 1/1985 |

* cited by examiner

*Primary Examiner*—Jennifer E. Novosad
(74) *Attorney, Agent, or Firm*—Harrington Cipriani LLP

(57) ABSTRACT

A motor driven storage unit is configured to bring individual shelves to a standard handicapped accessible height for viewing and selection of product on shelves. The shelves are controllable and move in a continuous path that has both a front vertical path and a rear vertical path. Stationary guide tracks and complimentary tracking elements connected to the shelves are used to keep shelves stable. A connecting lever is used to attach the shelves to the chain or other transport means and along with the tracking system ensures that fill storage utilization of the shelves and the space between them can occur.

11 Claims, 9 Drawing Sheets

MOTOR DRIVEN STORAGE SYSTEM

I claim the benefit of provisional patent 60/670,039 filed on Apr. 11, 2005

BACKGROUND

1. Field of the Invention

The present invention relates to closet space improvement and increased functionality of home storage. It relates in general to shelving that display goods for viewing and selection. More particularly the invention relates to a powered carousel unit configured to bring shelves to a standard height.

2. Description of Prior Art

There are many different means for storing household items with some of the current design approaches being stationary shelves, baskets, drawers or in some cases square cubicles. These designs are used through out the home including bedroom closets, kitchen pantries, etc. These methods are effective but they do not allow storage capacity to be significantly improved. Nor do they allow every storage container to be brought to a convenient height for access to its contents. The present invention overcomes these relatively static approaches by utilizing a motor driven vertical carousel to improve storage capacity and increase the ease to which goods can be retrieved.

A variety of carousel shelving units are known and have been used in a variety of settings for various purposes. For example U.S. Pat. No. 2,912,118, U.S. Pat. No. 4,314,647, U.S. Pat. No. 6,119,880 and U.S. Pat. No. 6,854,815 all disclose vertical carousel shelving units of different configurations, some of which could be used for home storage. However, none of these carousel shelving units have gained any acceptance for use in the home. To date, no efficient or effective carousel unit is available or in widespread use in the home because the designs are too complex to be affordable or they simply don't work well enough. Furthermore, there are some handicapped products that automatically lower shelves to an accessible height for the physically challenged but there are no carousels that are available or in widespread use to solve the same problem.

A key point for carousel design is a guide system that is simple, effective and allows for the shelves to not have to be spaced so far apart vertically that space is wasted. To accomplish this, the guide system must work in conjunction with a lever arm connected to the chain or other transport means so as to give the shelves enough angular velocity so that the shelves don't make contact with each other as they travel from front to back and from back to front. U.S. Pat. No. 2,912,118 accomplishes this in its design but not with out using additional parts from what is required in the present invention. U.S. Pat. No. 4,314,647, U.S. Pat. No. 6,119,880 and U.S. Pat. No. 6,854,815 are the other patents that are closest to the present invention but they do not accomplish this feature and hence they require a significant amount of space between shelves where no storage can occur. Also, if the shelves are open on the top this can also result in serious jamming of the system if items that are too tall are placed on the shelf. This problem along with other issues are solved by the design of the present invention.

3. Objects and Advantages

Several objects and advantages of the present invention are:

a) A simple guide system that prevents unnecessary swinging of shelves, is quiet when in operation and cannot jam.

b) A guide system that allows for easy installation and removal of shelves.

c) A connecting lever that attaches to the transport chain to ensure that shelves can be properly spaced so that no space is wasted.

d) A simple and effective means for attaching the connecting lever to a standard roller chain which is used to transport the shelves.

e) A mechanism for ensuring that no slack can occur in the transport chain and that the chain is always in tension.

f) An accessible means for retrieving stored items for persons of varying height including those that are physically challenged and or use a wheel chair Still further objects and advantages will become apparent from a consideration of the ensuing description and drawings.

SUMMARY

In accordance with the present invention, the motor driven storage system is provided with a plurality of shelves that are pivotally suspended in a normal horizontal position for movement along a vertical carousel path. The carousel path is characterized as having a front path segment, a back path segment and a circular top and bottom path segments connecting the front and back path segments together to establish a continuous path. A controllable drive unit is connected for powered movement of the shelves along the carousel path, and for positioning of individual shelves at a predetermined access height along the front path. A pair of stationary track systems is located on each side of the shelves, tracking generally along the carousel path of the shelves. The shelves are provided with tracking elements connected for movement therewith and operatively engaging the track systems as the shelves travel along the carousel path.

DRAWINGS (INFORMAL)

DESCRIPTION OF THE PREFERRED EMBODIMENT

Figure 1A:
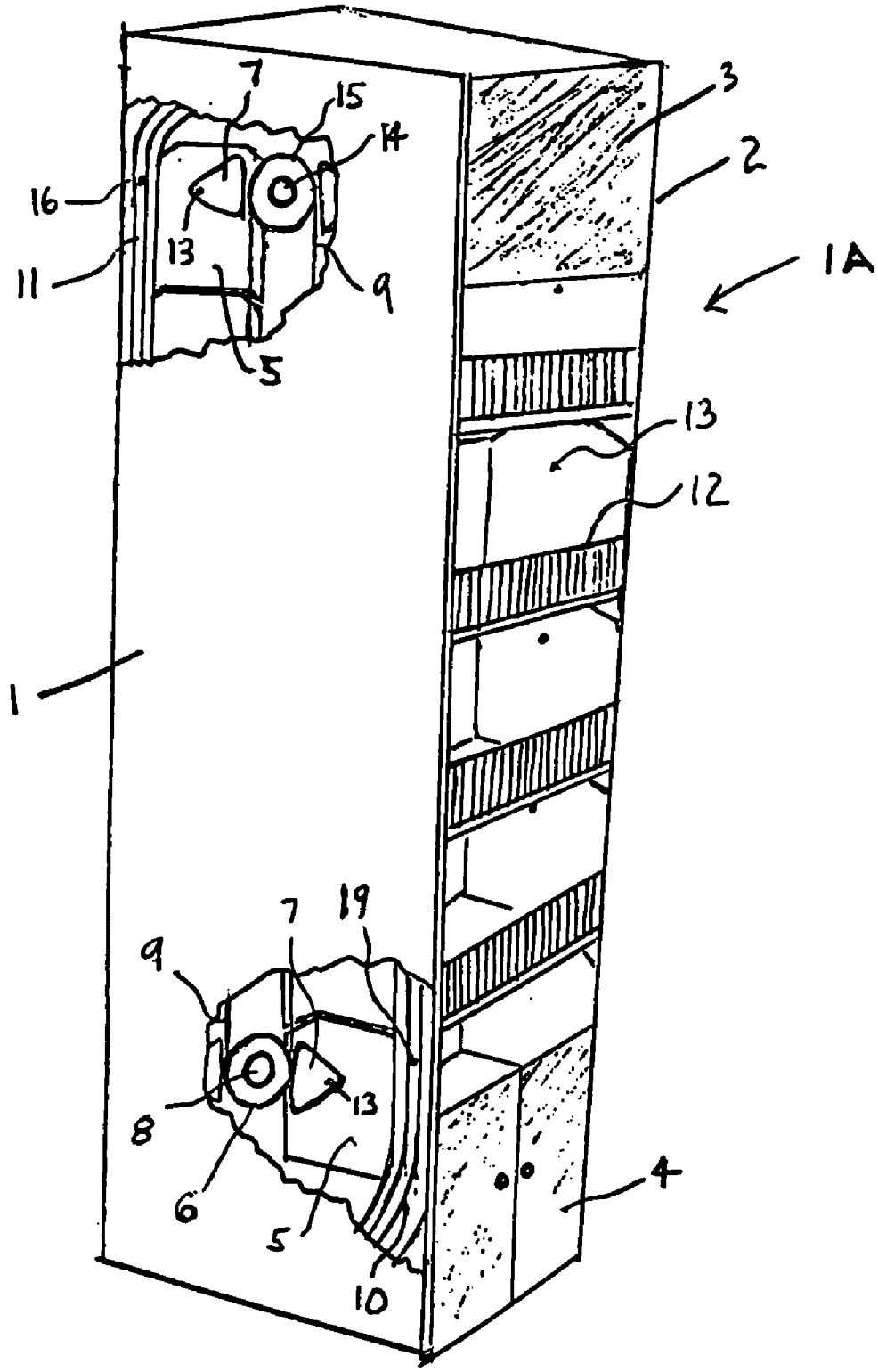
FIG. 1A shows a perspective view of the motor driven storage system.

FIG. 1A illustrates the motor driven storage system 1A which includes a left side support 1 and a right side support 2. These supports can be the sides of a home closet or the sides of a typical standard shelving system. The left and right support frames 1, 2 are illustrated as being made of wood melamine but can be formed of various beams in skeletal form reinforced with metal support plates that could hold the infrastructure of the motor driven storage system 1A. Container shelves 5 are also shown with a shelf cage 12 and are stacked vertically. Different shelving designs are available depending on what is being stored. Also, shown is a top enclosure panel 3 and at the bottom is a bottom enclosure 4. The bottom enclosure 4 has the ability to open and close for maintenance. When installed the storage system would become a permanent fixture of the home or building and in most cases would go from the floor to the ceiling (8 or 10 ft)

The bottom break out of FIG. 1A shows a container shelf 5 that is connected to a left chain 9 by a connecting pin 13 that connects the container shelf 5 to a connecting lever 7 that then attaches to the left chain 9. Also on the container shelf 5 is a left front pin 19 that runs in a left front guide track 10. Also shown is a lower left sprocket 6 that left chain 9 integrates with along with a lower left bearing flange 8.

The top break out of FIG. 1A shows a container shelf 5 that is connected to a left chain 9 by a connecting pin 13 that connects the container shelf 5 to a connecting lever 7 that then attaches to the left chain 9. Also on the container shelf 5 is a left rear pin 16 that runs in a left rear guide track 11. Also shown is an upper left sprocket 15 that left chain 9 integrates with along with a upper left bearing flange 14.

Figure 1B:
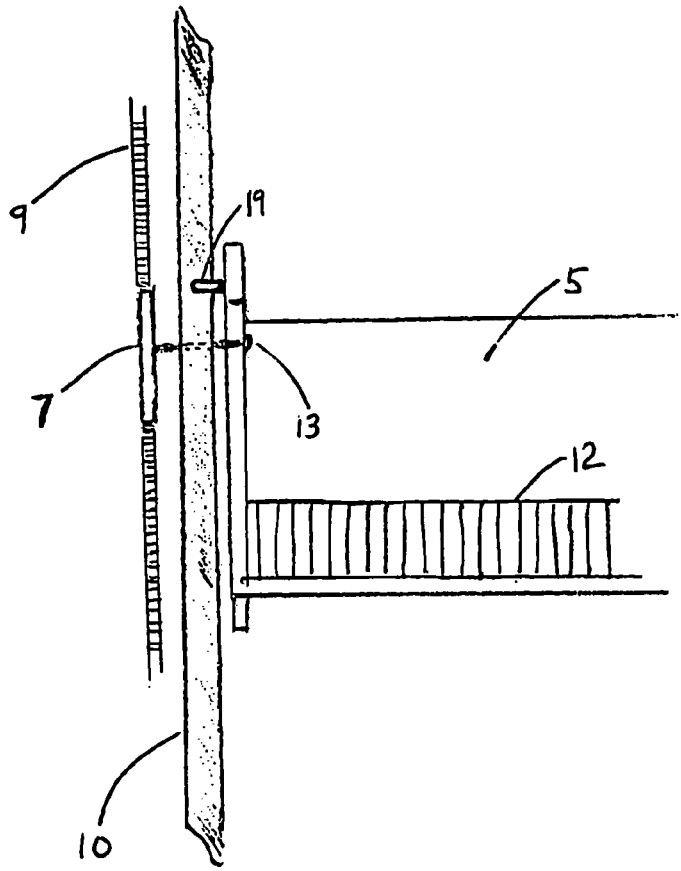
FIG. 1B shows a front view of the shelf, guide and connecting lever.

In FIG. 1B container shelf 5 is shown with shelf cage 12. It is attached to connecting lever 7 by connecting pin 13. Connecting lever 7 is attached to left chain 9. Left front pin 19 spins freely and runs in the left front guide track 10.

Figure 1C:
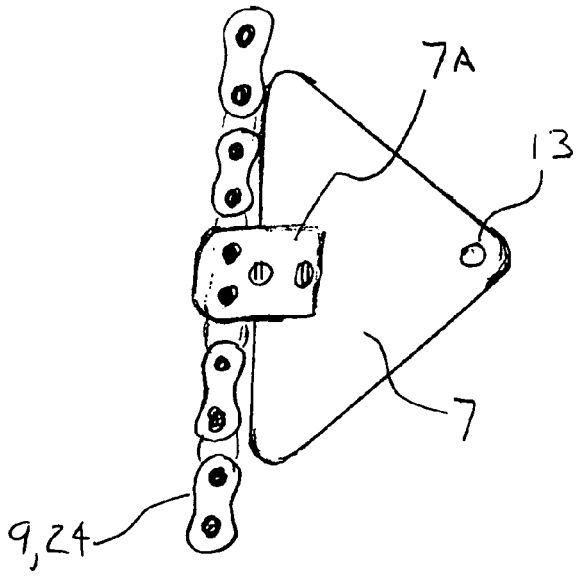
FIG. 1C shows a front view of the connecting lever, plate and chain

In FIG. 1C a plate 7*a* is shown that is used to attach connecting lever 7 to left chain 9 and right chain 24. This plate provides a means for attachment to the rivots of the chain. The connecting lever width is equal or slightly less than the width of the chain link and is made out of slightly compressible material such as plastic. The plate 7*a* is located on each side of the chain and both are fastened together, with the connecting lever in the middle, using machine screws. Because the width of the connecting lever matches the width of the chain a tight bond between the two is possible.

Figure 2A:
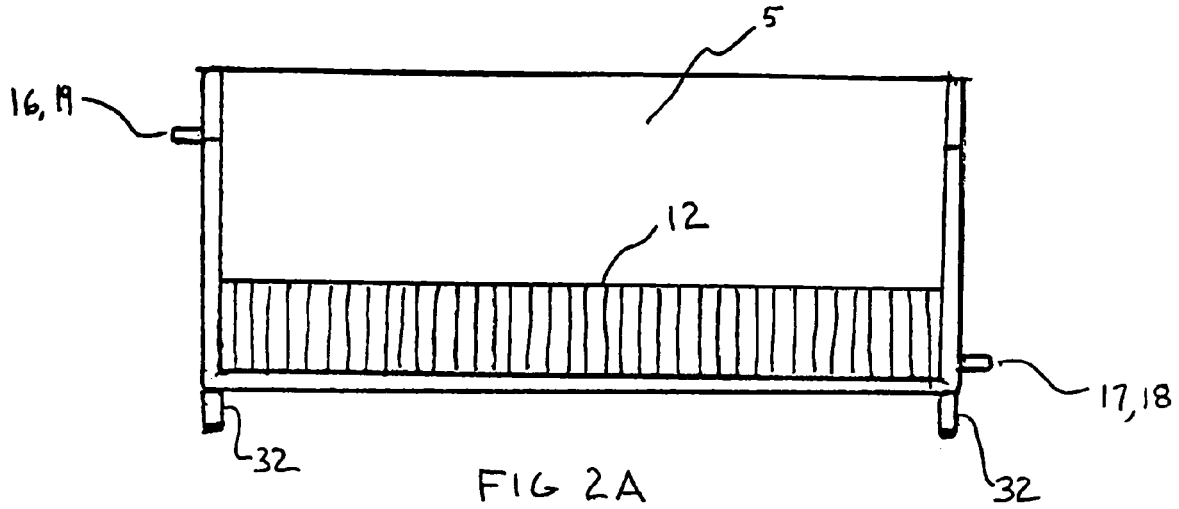
FIG. 2A shows a front view of the container shelf.

FIG. 2A shows container shelf 5 in a front view. Left rear pin 16 and left front pin 19 are on one side of the container shelf 5 and a right rear pin 17 and right front pin 18 are on the other side of container shelf 5. At the bottom are locking blocks 32.

Figure 2B:
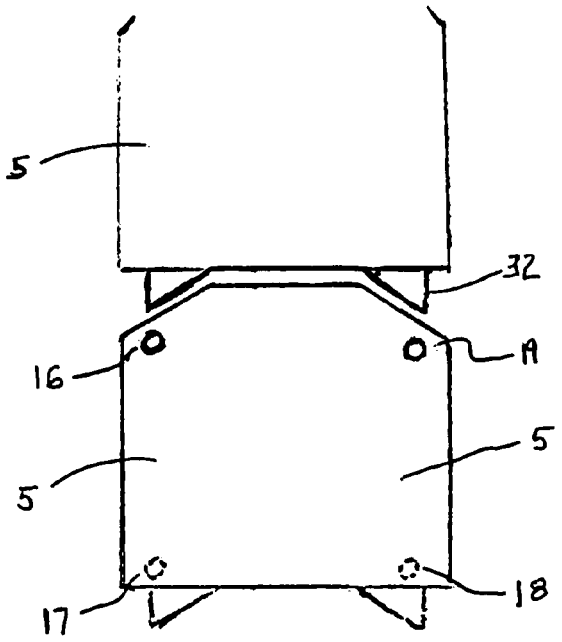
FIG. 2B shows a side view of the container shelf.

In FIG. 2B the locking blocks 32 are shown locking two container shelves 5 to each other. FIG. 2B also shows where the pins 16,17,18,19 are located from the side view on the container shelf 5. Right rear pin 17 and right front pin 18 are shown as hidden in this view.

Figure 3A:
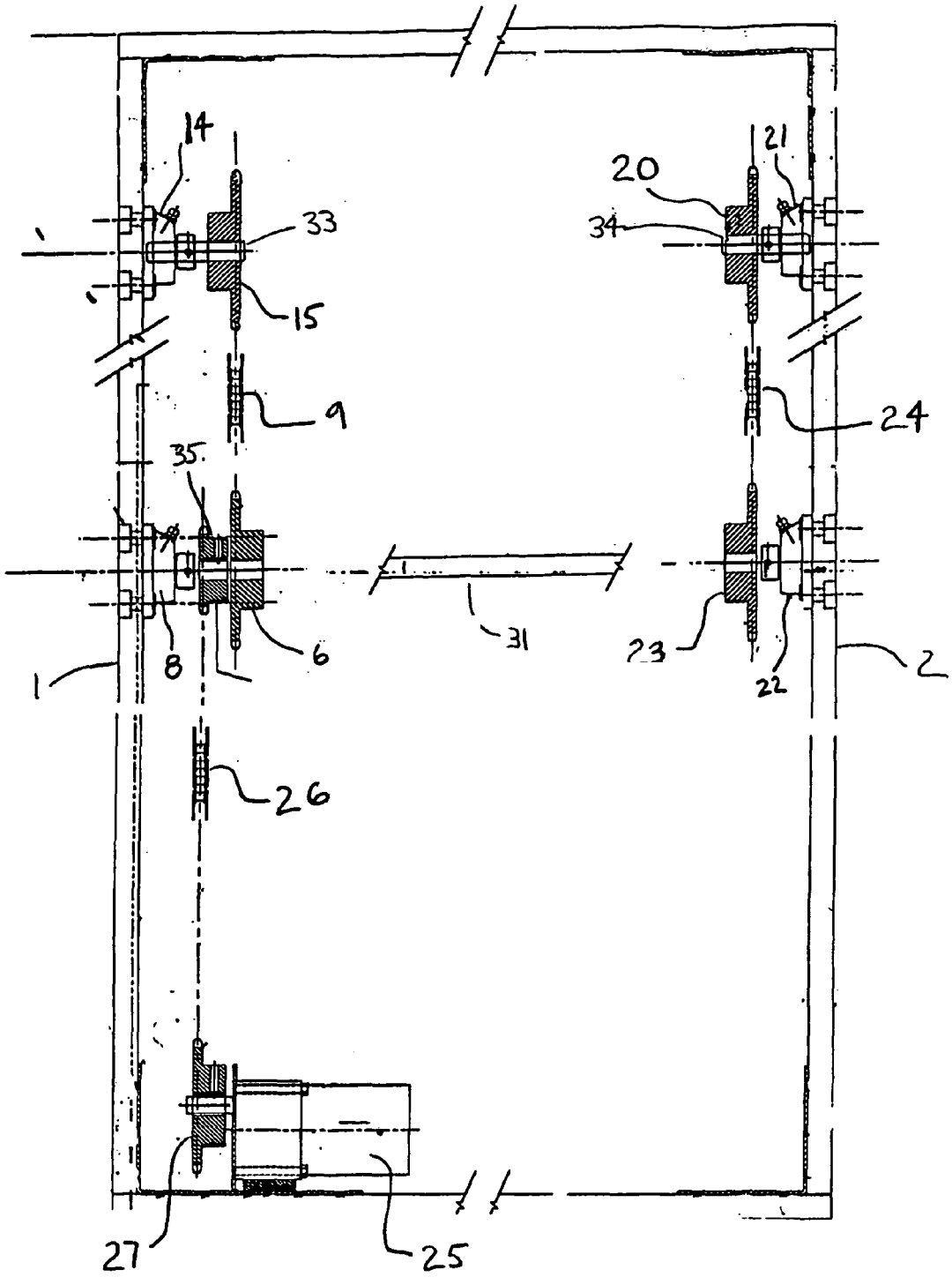
FIG. 3A shows a front view of the internal structure and the motor.

FIG. 3A shows from the front view the internal structure. Upper left sprocket 15 is attached to upper left bearing flange 14 by means of a left stub axle 33. The upper left sprocket 15 is integrated to left chain 9 and is synchronous with lower left sprocket 6, which is also attached to left chain 9. Lower left sprocket 6 connects with a lower right sprocket 23 by means of a drive shaft 31. At the left end of drive shaft 31 is lower left bearing flange 8 and at the right end is lower right bearing flange 22. The lower right sprocket 23 is integrated to right chain 24 and is synchronous with upper right sprocket 20 which is also attached to right chain 24. Upper right sprocket 20 is attached to upper right bearing flange 21 by means of a right stub axle 34. Upper and lower left bearing flanges 14, 8 are supported by left side support 1 and upper and lower right bearing flanges 21, 22 are supported by right side support 2.

At the bottom of FIG. 3A is shown an electric motor 25, which has a motor sprocket 27. Motor sprocket 27 connects to motor chain 26, which turns a drive sprocket 35 which is fixed to drive shaft 31.

Figure 3B:
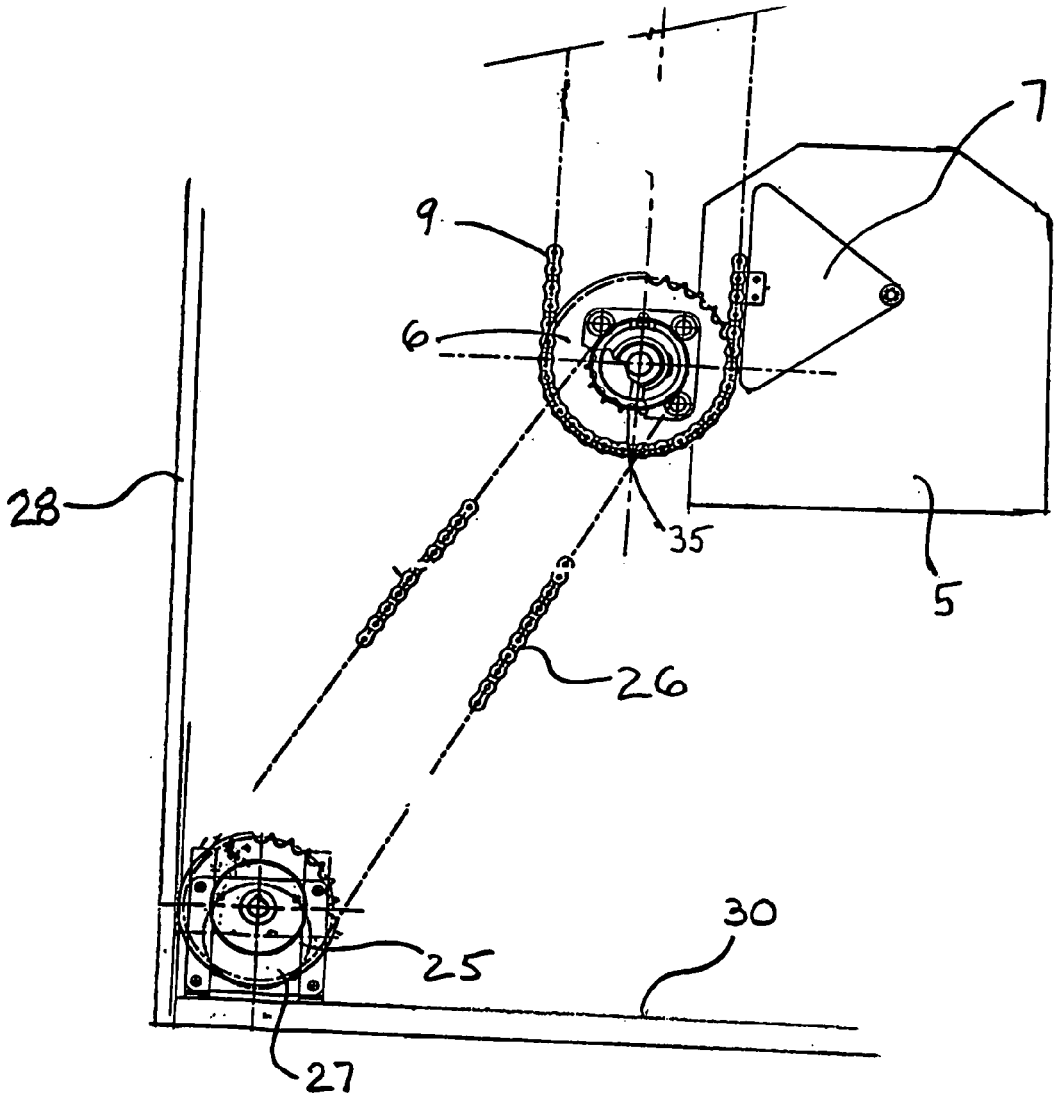
FIG. 3B shows a side view of the internal structure and the motor.

FIG. 3B shows a side view of electric motor 25 and motor sprocket 27. It is positioned at the corner of a rear support 28 and a bottom support 30. The bottom support 30 can be merely the floor of the closet as can the rear support 28 be merely the rear wall of a closet. Also shown is a side view of motor chain 26 connecting to drive sprocket 35. In addition a side view is shown of one of the container shelves 5 along with the connecting lever 7, lower left sprocket 6 and left chain 9.

Figure 4A:
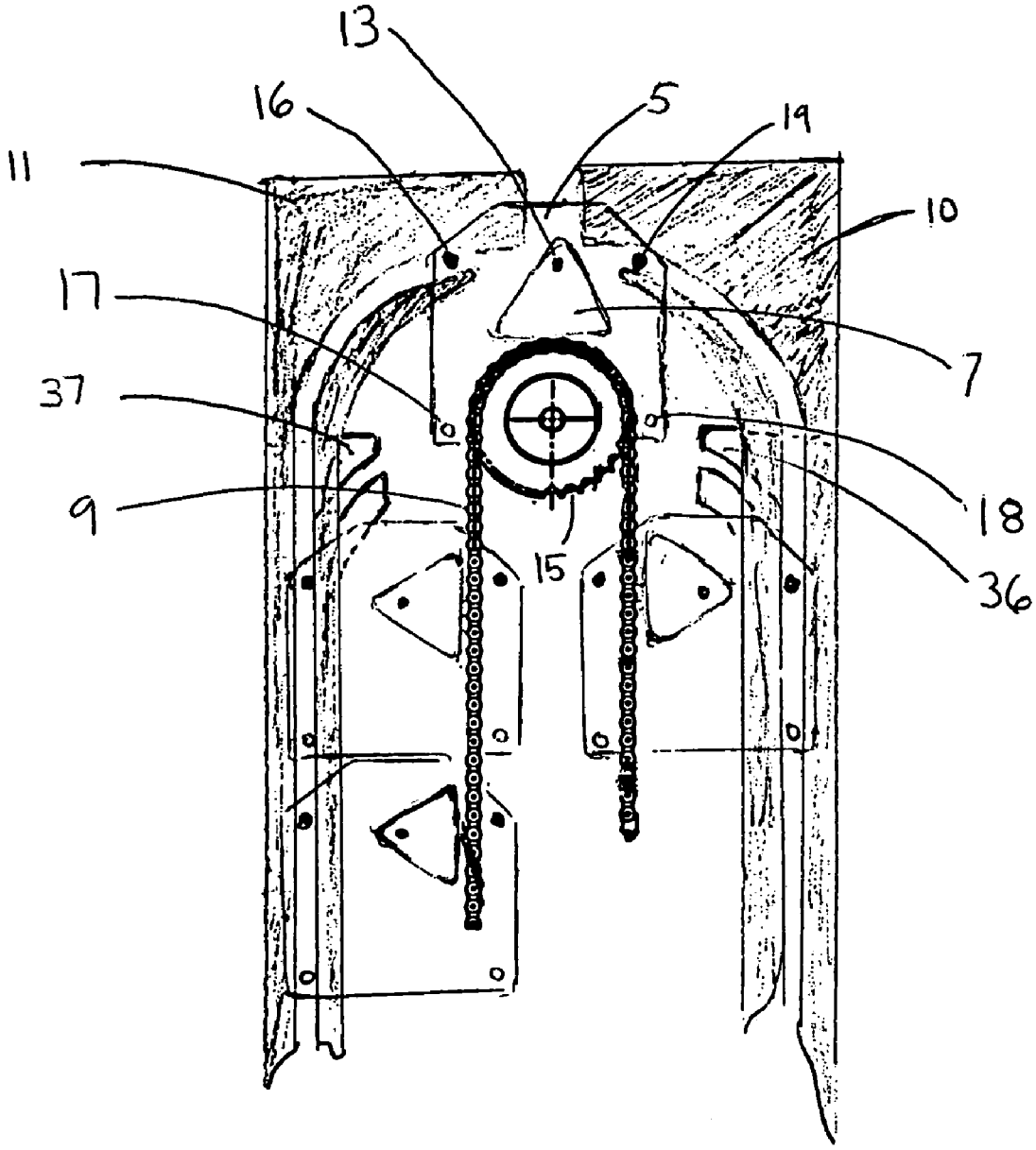
FIG. 4A shows a left side view of the guide tracks.

FIG. 4A shows the left front guide track 10 and the left rear guide track 11. Behind the left front guide track 10 and on the opposite end of the container shelf 5 is the right front guide track 36. Behind the left rear guide track 11 and on the opposite end of the container shelf 5 is the right rear guide track 37. The left front pin 19 moves in the left front guide track 10 and the left rear pin 16 moves in the left rear guide track 11.

Figure 4B:
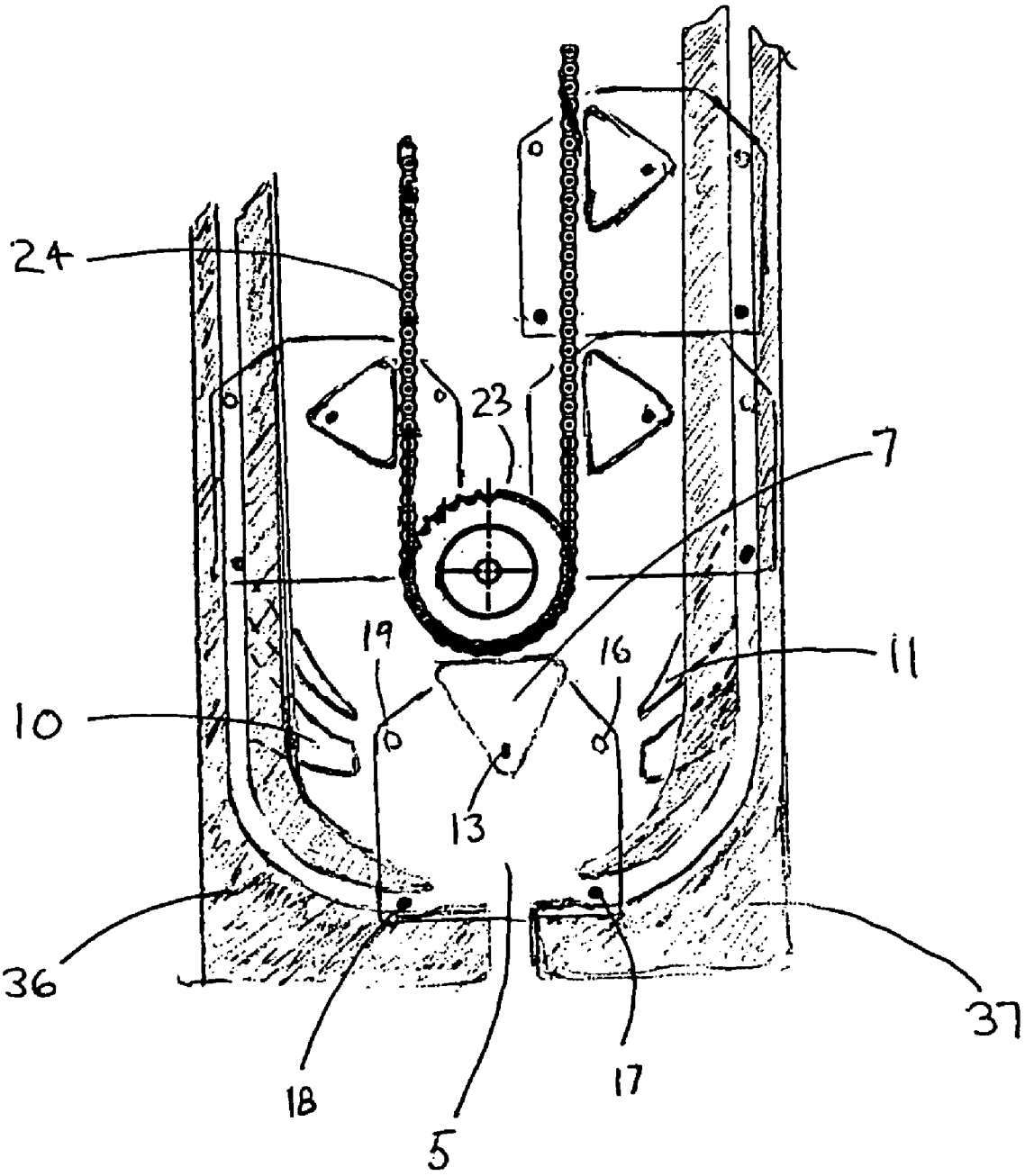
FIG. 4B shows a right side view of the guide tracks.

FIG. 4B shows the right front guide track 36 and the right rear guide track 37. Behind the right front guide track 36 and on the opposite end of the container shelf 5 is the left front guide track 10. Behind the right rear guide track 37 and on the opposite end of the container shelf 5 is the left rear guide track 11. The right front pin 18 moves in the right front guide track 36 and the right rear pin 17 moves in the right rear guide track 37.

Each guide track (10,11,36,37) is padded with between ⅛ inch and ¼ inch soft elastic material in order to reduce noise. This padding is on both sides of the track and is placed anywhere that the pins (16,17,18,19) make contact with the guides.

Operation of the Preferred Embodiment

The purpose of the invention is to create more usable closet storage space and also increase the ease of selection when removing items from storage in the home or business. The invention is basically an electric motor driven vertically revolving carousel. It will effectively double usable shelf space by bringing items in the back to the front and will also allow for easier selection by bringing items to eye level view. It can be used in the home for food supplies in the pantry, shoes in the bedroom closet, light duty storage in the garage, workshop, etc. It can also be used in restaurants or other businesses where increased light duty useful storage is required. It is designed to be used by everyone but would be most beneficial to handicapped individuals or others with physical limitations.

The operation of the storage system is such that the container shelves 5 (FIG. 1A) can be moved up or down and powered by an electric motor in order to find storage items with ease. It functions by user contact with two pushbuttons, one for up and one for down. The button pushed is held until the shelf that is requested has presented itself to the user. The switch can also be a toggle or paddle switch that is of the momentary on-off-on variety. The speed is designed so that the users can examine shelf contents satisfactorily while the shelves move by as he/she actuates the up or down button. Shelves in the center rear move to the center front in about 10 to 12 seconds. When the desired container shelf 5 is found, the shelf stays in place when the user releases the push button by means of a brake that is built into the motor that drives the storage system.

When container shelves 5 travel up and down in the vertical direction they lock into position for rigidity by means of locking blocks 32 (FIG. 2B). The locking gives the shelves stability and the feeling of stationary shelves when objects are inserted and removed by hand. The container shelves also do not need to have any dead space between them when they are in the vertical position because the connecting lever 7 (FIG. 1A,1B) moves the container shelves at a faster rate when transferring from front to back and back to front so that no collisions between shelves can occur. The connecting lever 7 (FIG. 1A,1B) is designed hold the connecting pin 13 (FIG. 1A,1B) that pivotally supports the container shelf 5 (FIG. 1A) The connecting lever 7 (FIG. 1A,1B) is triangular in shape and also is designed to ensure that no slack can occur in left chain 9 (FIG. 3A) and right chain 24 (FIG. 3A). The weight of the container shelves in combination with the connecting lever 7 act as a chain tensioning device so as to ensure no slack can be developed in the chains.

The container shelves 5 are kept stable and level as they travel and move from back to front and front to back in the storage system. There are four guides for this purpose. They are (FIG. 4A) left front guide track 10, left rear guide track 11, (FIG. 4B) right front guide track 36 and right rear guide track 37. The design is such that only one pin integrates with one track. The design is such that only left front pin 19 (FIG. 4A) rides in left front guide track 10, only left rear pin 16 rides in left rear guide track 11, only right rear pin 17 (FIG. 4B) rides in right rear guide track 37 and only right front pin 18 rides in right front guide track 36. As the container shelves 5 (FIG. 1A) move, at least one or more pins are always in a guide track keeping the shelves level and stable. In FIG. 4A when pins 19 and 18 are in their tracks pins 16 and 17 are not in their tracks. As the shelves move from front to back, right front pin 18 leaves its track as left rear pin 16 enters its track. During this transfer, left front pin 19 holds the shelf in position. When left front pin 19 leaves its track right rear pin 17 enters its track. During this transfer, left rear pin 16 holds the shelf in position. In FIG. 4B when pins 16 and 17 are in their tracks pins 19 and 18 are not in their tracks. As the shelves move from back to front, left rear pin 16 leaves its track as right front pin 18 enters its track. During this transfer, right rear pin 17 holds the shelf in position. When right rear pin 17 leaves its track left front pin 19 enters its track. During this transfer, right front pin 18 holds the shelf in position. The discontinuity of the tracks is necessary to keep collisions with the connector pin 13 and its travel path from occurring.

Description of the First Alternative Embodiment

The first alternative embodiment includes everything in the preferred embodiment except the pins 16,17,18,19 (FIGS. 4A and 4B) located on the container shelf 5 and the tracks 10,11 (FIG. 4A) 36, 37 (FIG. 4B) that they integrate with. The contents of FIGS. 5A and 5B replace these items.

Figure 5A:
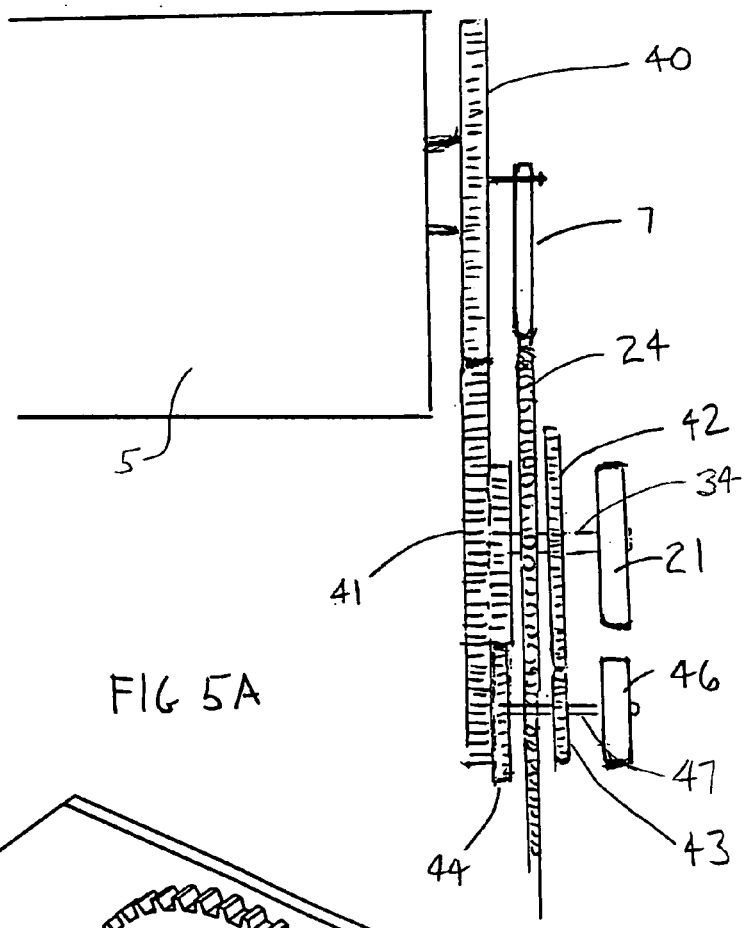
FIG. 5A shows a side view of the gear assembly (First alternative embodiment)
Figure 5B:
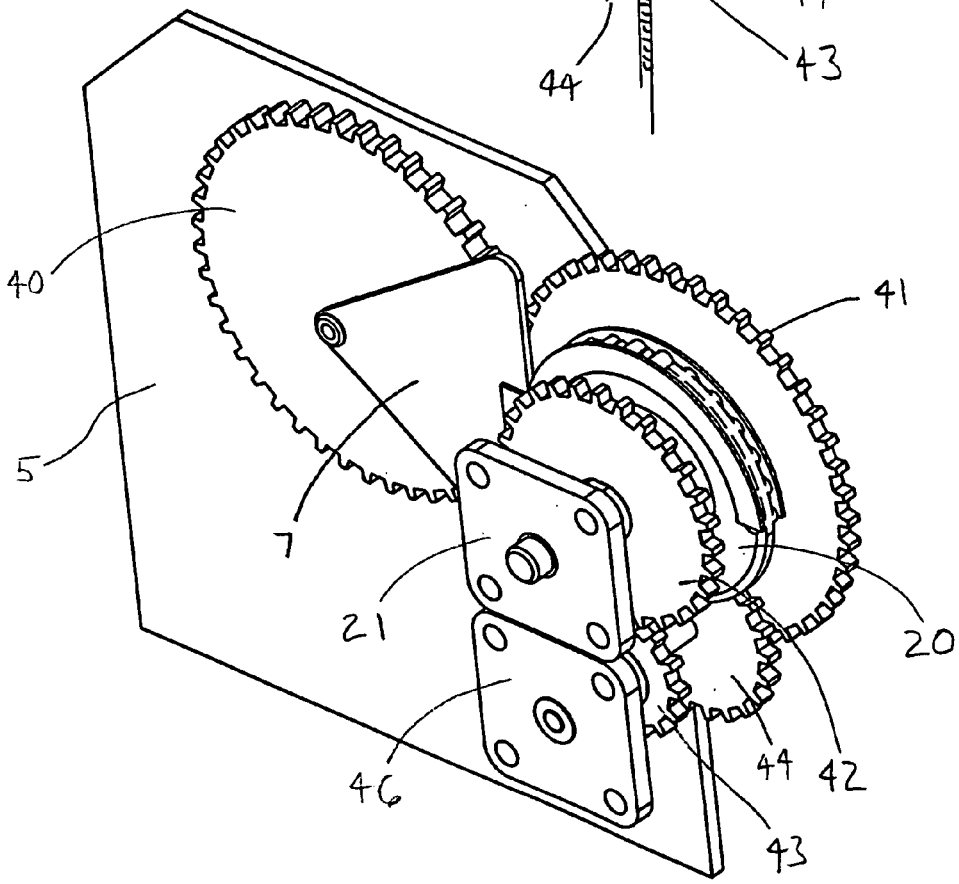
FIG. 5B shows a perspective view of the gear assembly (First alternative embodiment)

FIGS. 5A and 5B shows the following. A plastic gear 40 is fixed to the container shelf 5, which integrates with plastic gear 41. Plastic gear 41 has 2 gear surfaces, which are attached to each other and the total unit spins freely on right stub axle 34. The inner gear surface of plastic gear 41 is driven by a plastic gear 44, which is fixed to shaft 47. Shaft 47 is driven by plastic gear 43, which is driven by a plastic gear 42 that is fixed to the right stub axle 34. The shaft 47 has a bearing flange 46 to give it support.

The part assemblies that are shown in FIG. 5A and FIG. 5B are located at both the top and bottom on the right hand side of the motor driven storage system.

Operation of the First Alternative Embodiment

The first alternative embodiment is used to keep container shelves level as they move from front to back and back to front. This replaces the operation of the tracks 10,11 (FIG. 4A) 36, 37 (FIG. 4B) and pins 16,17,18,19 (FIGS. 4A and 4B). When a container shelf is raised or lowered to a point where it begins to move from back to front or front to back, the plastic gear 40 (FIG. 5A) that is located on the container shelf 5 (FIG. 5A) begins to make contact with plastic gear 41 (FIG. 5A, 5B). As it moves front to back or back to front, gear 41 (FIG. 5A, 5B) keeps the container shelf level by turning gear 40 (FIG. 5A,5B). This is what keeps the container shelf stable and keeps it from swinging. Plastic gear 41 spins freely on shaft 34 and because it is driven by the gearing shown, spins at twice the rate of upper right sprocket 20 (FIG. 5B). As the container shelf begins to end its transfer from the back or the front the plastic gear 40 automatically disengages from plastic gear 41.

This operation for stabilization occurs at both the top and bottom of the motor driven storage system.

Description of the Second Alternative Embodiment

The second alternative embodiment is a bottom access storage system 48 shown in FIG. 6A and is used for closet designs that wish to have stationary shelves below the carousel unit. It includes everything that is in the preferred embodiment except that the access point for selecting items is at the bottom of the unit. This allows for the bottom access storage system 48 (FIG. 6A) to be placed such that the highest point an individual can reach would be the bottom of the unit and then normal reachable stationary shelves can then be placed below the carousel unit. This allows for a complete closet design where normal shelves are used where you can reach and a motor driven system is used for shelves that you would normally not be able to reach. Also, because this alternative embodiment has the same connecting lever 7 (FIG. 1A,1B) as the preferred embodiment there is slightly more space at the bottom of the unit for inserting and removing items as the connecting lever 7 (FIG. 1A,1B) places the shelves lower then the others and causes an opening as shelves move from front to back and back to front.

Figure 6A:
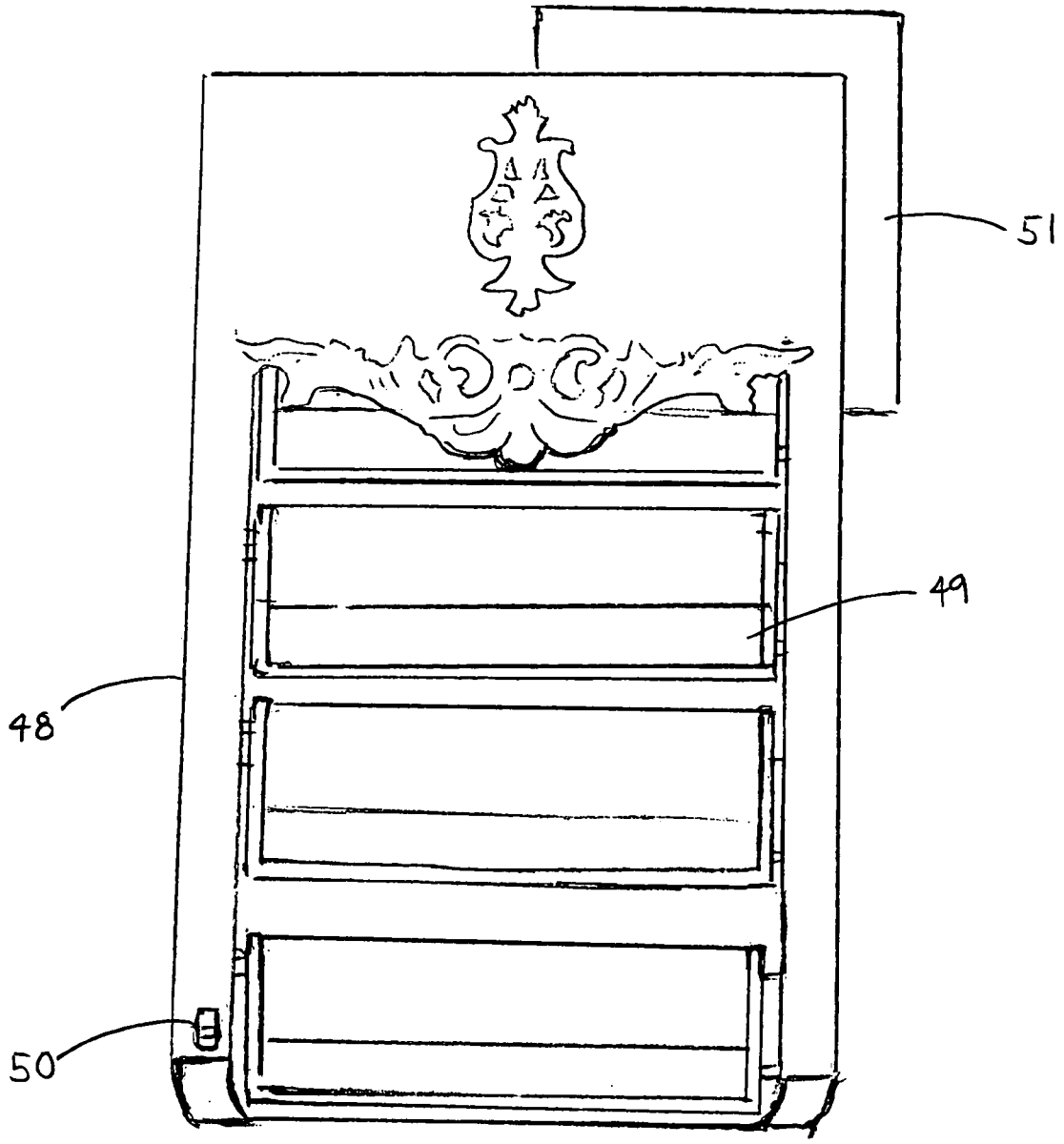
FIG. 6A shows a front view of the motor driven storage system with bottom access (Second alternative embodiment)

FIG. 6A shows the following; the bottom access storage system 48, a clear acrylic guard 49 that replaces the shelf cage 12 (FIG. 1A,2A) from the preferred embodiment, a switch 50 that is of the momentary on-off-on variety that controls the shelf movement. Also shown is a cover 51 that encloses the motor drive system shown in FIG. 3B of the preferred embodiment. This motor drive system is now at the top of the carousel unit instead of at the bottom as was shown for the preferred embodiment.

Operation of the Second Alternative Embodiment

The second alternative embodiment operates exactly as the preferred embodiment except that the second alternative embodiment allows for access of items at the bottom of the unit.

Conclusion, Ramifications and Scope

Accordingly the reader will see that the motor driven storage system in many respects is a superior design over the prior art. This is because the design is simple using significantly fewer parts yet at the same time increases the shelf space utilization.

The tracking system that is discontinuous allows for easy mounting and dismounting of the shelves. The tracking system is unique in that at the top of the carousel unit, the left side tracking system controls shelf stabilization and at the bottom, the right side tracking system controls shelf stabilization. The pin placement on the shelves is also unique and allows for greater reduction of unnecessary shelf pivoting along with ensuring that no collision between the shelf connecting pin and the tracking system can occur. Also, the padding on the tracking system ensures quiet operation.

The triangular shaped connecting lever for attaching shelves to the chain ensures that the chain is always in tension and cannot come off as it wears and stretches with age. The connecting lever also delivers enough angular velocity so that shelves don't collide when reaching the radial portions of the carousel path at the top and bottom of the unit.

The plate used to attach the connecting lever to the chain is also unique as it allows a standard roller chain to be effectively used in the design instead of the much more expensive standard roller attachment chain.

Furthermore the motor driven storage system allows for access of stored items not only in the front carousel path as shown in most all of the prior art but also at the bottom of the carousel path as well.

Although the description above contains many specificities, these should not be construed as limiting the scope of the invention but merely providing illustrations of some of the advantages and embodiments of this invention.

I claim:

1. A system for storing articles in a movable disposition for selective presentation to a user, comprising:

a plurality of shelf members each comprising a support surface for supporting the articles;

first and second guide tracks for guiding movement of each of the shelf members along a predetermined path, wherein the guide tracks are adapted to receive respective first and second sets of guide pins connected to respective first and second sides of each of the shelf members, the guide pins spinning freely and running in the guide tracks during the movement of the shelf members;

drive means for driving the plurality of shelf members along the predetermined path; and a plurality of connecting levers each connected to the drive means and each pivotally connected to one of the shelf members for maintaining the support surface in a horizontal position as the shelf member travels along the predetermined path;

wherein the drive means is selectively actuated to advance the shelf members to present a selected article to the user at an access height along the predetermined path.

2. A system according to claim 1, wherein the predetermined path is a rotational path comprising substantially linear front and rear path parts and substantially semicircular top and bottom path parts.

3. A system according to claim 2, wherein the connecting lever is adapted to accelerate each shelf member through the top and bottom path parts to prevent interference between adjacent shelf members as the shelf members transition from path part to path part.

4. A system according to claim 2, wherein each of the shelf members is provided with corresponding locking blocks and block receiving recess for stabilizing the shelf members as the shelf members are driven along at least the front path part.

5. A system according to claim 1, wherein the drive means comprises first and second drive chains disposed adjacent respective first and second sides of each shelf member.

6. A system according to claim 5, wherein one of the connecting levers is pivotally connected to each of the first and second sides of the shelf members and connected to respective first and second drive chains.

7. A system according to claim 6,wherein each of the connecting levers is shaped to allow weight of the shelf members to tension the drive chains.

8. A system according to claim 1, wherein the guide tracks are padded to dampen sound produced as the shelf members are driven along the predetermined path.

9. A system according to claim 1, wherein:

the predetermined path is a rotational path comprising substantially linear front and rear path parts and substantially semicircular top and bottom path parts;

the first set of guide pins comprises front and rear first guide pins and the second set of guide pins comprises front and rear second guide pins;

the first guide pins are disposed relatively higher than the second guide pins; and the guide tracks are configured to receive the guide pins selectively according to a position of the shelf member along the rotational path.

10. A system according to claim 9, wherein the guide tracks and guide pins are successively disposed, during travel of one of the shelf members through the predetermined path, (a) in a first configuration with the front first guide pin in the first guide track and the front second guide pin in the second guide track, when the shelf member is in the front path part;

(b) in a second configuration with the front second guide pin and the rear second guide pin in the second guide track, when the shelf member is at the bottom of the bottom path part;

(c) in a third configuration with the rear first guide pin in the first guide track and the rear second guide pin in the second guide track, when the shelf member is in the rear path part; and (d) in a fourth configuration with the front first guide pin and the rear first guide pin in the first guide track, when the shelf member is at the top of the top path part; and wherein the guide tracks are configured to permit the guide pins to enter and exit during transitions between the configurations.

11. A system for storing articles in a movable disposition for selective presentation to a user, comprising:

a plurality of shelf members each comprising a support surface for supporting the articles;

first and second guide tracks for guiding movement of each of the shelf members along a predetermined path, wherein the guide tracks are adapted to receive respective first and second sets of guide pins connected to respective first and second sides of each of the shelf members;

drive means for driving the plurality of shelf members along the predetermined path; and a plurality of connecting levers each connected to the drive means and each pivotally connected to one of the shelf members for maintaining the support surface in a horizontal position as the shelf member travels along the predetermined path;

wherein the drive means is selectively actuated to advance the shelf members to present a selected article to the user at an access height along the predetermined path;

wherein the predetermined path is a rotational path comprising substantially linear front and rear path parts and substantially semicircular top and bottom path parts;

wherein the first set of guide pins comprises front and rear first guide pins and the second set of guide pins comprises front and rear second guide pins;

wherein the first guide pins are disposed relatively higher than the second guide pins;

wherein the guide tracks are configured to receive the guide pins selectively according to a position of the shelf member along the rotational path;

wherein the guide tracks and guide pins are successively disposed, during travel of one of the shelf members through the predetermined path, (a) in a first configuration with the front first guide pin in the first guide track and the front second guide pin in the second guide track, when the shelf member is in the front path part;

(b) in a second configuration with the front second guide pin and the rear second guide pin in the second guide track, when the shelf member is at the bottom of the bottom path part;

(c) in a third configuration with the rear first guide pin in the first guide track and the rear second guide pin in the second guide track, when the shelf member is in the rear path part; and (d) in a fourth configuration with the front first guide pin and the rear first guide pin in the first guide track, when the shelf member is at the top of the top path part; and wherein the guide tracks are configured to permit the guide pins to enter and exit during transitions between the configurations.

* * * * *